US007396103B2

(12) United States Patent
Nishino

(10) Patent No.: US 7,396,103 B2
(45) Date of Patent: Jul. 8, 2008

(54) INKJET RECORDING APPARATUS AND METHOD FOR MAINTENANCE OF RECORDING HEAD

(75) Inventor: Satoshi Nishino, Sayama (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 486 days.

(21) Appl. No.: 11/097,290

(22) Filed: Apr. 4, 2005

(65) Prior Publication Data

US 2005/0225620 A1 Oct. 13, 2005

(30) Foreign Application Priority Data

Apr. 7, 2004 (JP) ..... 2004-112772

(51) Int. Cl.
*B41J 2/015* (2006.01)

(52) U.S. Cl. ..... 347/20; 347/23; 347/102

(58) Field of Classification Search ..... 347/20, 347/102, 23, 100, 19, 29, 101
See application file for complete search history.

(56) References Cited

U.S. PATENT DOCUMENTS 6,179,403 B1 * 1/2001 Xie et al. ..... 347/23
2003/0222961 A1 * 12/2003 Nakajima ..... 347/102
2004/0223029 A1 * 11/2004 Nishino ..... 347/33
2005/0099478 A1 * 5/2005 Iwase ..... 347/102

* cited by examiner

*Primary Examiner*—Manish S Shah
(74) *Attorney, Agent, or Firm*—Finnegan, Henderson, Farabow, Garrett & Dunner, L.L.P.

(57) ABSTRACT

An inkjet recording apparatus includes a carriage having a recording head for jetting UV-curable ink onto a recording medium and a UV light emitter for projecting UV light onto ink having landed on the recording medium to cure the ink, and a maintenance unit for performing maintenance of the recording head. The apparatus further includes an input section for inputting a type of recording medium, a storage section for storing plural types of recording media and corresponding plural maintenance intervals, and a controller for controlling the maintenance unit such that the controller selects a maintenance interval, corresponding to the type of recording medium having been input through the input section, and performs maintenance, according to the selected maintenance interval. A method for maintenance of a recording head selects a maintenance interval, corresponding to the type of recording medium having been input, and performs maintenance, according to the selected maintenance interval.

9 Claims, 5 Drawing Sheets

INKJET RECORDING APPARATUS AND METHOD FOR MAINTENANCE OF RECORDING HEAD

This application is based on Japanese Patent Application No. 2004-112772 filed on Apr. 7, 2004, in Japanese Patent Office, the entire content of which is hereby incorporated by reference.

FIELD OF THE INVENTION

The present invention relates to an inkjet recording apparatus, and particularly relates to an inkjet recording apparatus that jets UV-curable ink and projects UV light to record an image on a recording medium.

BACKGROUND OF THE INVENTION

In recent years, inkjet recording devices, which are inkjet type image recording devices, have come to be used more than gravure printing type or flexo printing type devices, which require prepress process, because inkjet type image recording devices allows easy and inexpensive image forming.

In the field of image recording on commodities or packing materials for commodities by the use of such an inkjet recording device, materials such as resins or metals without ink absorbance are often used for commodities or packing of commodities. As inkjet recording devices that fix ink to a recording medium of such a material having no ink absorbance, inkjet recording devices of UV-curing type which uses UV-curable ink are known.

In general, in an inkjet recording device of UV-curable type, UV light is projected to UV-curable ink having landed on a recording medium so that the UV-curable ink is cured and fixed to the recoding medium. Herein, when the amount of UV light projection to a printing part is small, ink deposited on the recording medium somewhat spreads, resulting in creation of gloss. Conversely, when the amount of UV light projection is large, ink deposited on the recording medium spreads little, resulting in creation of a mat tone.

There is known an inkjet recording device that controls the amount of UV light projected onto a printing part to control the dot tone after printing so that a printing result is obtained in which gloss or mat tone is adjusted (Patent Document 1). A shutter is arranged at an opening, on the recording medium side, of a UV light emitting device in this recording device, wherein the opening degree is arbitrarily set to enable control of the amount of UV light projection onto a recording medium.

[Patent Document 1] TOKKAI No. 2004-1327

However, in an inkjet recording device that uses UV-curable ink, it is possible that UV-light for curing ink randomly reflects to parts other than a printing surface, for example, onto the-nozzle surface of a recording head, resulting in curing ink deposited on the nozzle surface to cause a jetting failure or the like. On the other hand, it is necessary to arrange a UV light emitter near recording heads so as to obtain a high image quality by curing ink immediately after printing. A carriage may be provided with a mechanism such as a light trap for absorbing or attenuating reflected light. However, it is impossible to absorb or attenuate all of reflected lights, and tiny reflected lights reach the nozzle surface of a recording head due to diffused reflection or the like.

Therefore, as is known, recording heads are maintained in order to remove ink deposited on the nozzle surfaces. Herein, UV-curable ink is applicable to any type of recording medium, allowing it to perform printing on any recording medium. However, the surface roughness and reflection rate are different depending on the recording medium. Therefore, the amount of light energy of reflected UV light reaching the nozzle surface of a recording head may be greater depending on the type of a recording medium even if the UV light projection time is the same. Therefore, if the maintenance interval is set to be the same all the time, there is a problem that the maintenance interval is too long for a recording medium which causes a large amount of light energy of reflected light.

Particularly, cation-curable ink has a characteristic of accumulating light energy, and accordingly even in the case of light energy in a tiny amount, light energy is accumulated as time elapses to finally cure the cation-curable ink. Further, ink having been cured once cannot be removed by maintenance. Therefore, it is necessary to perform maintenance before UV light projection time exceeds a certain time period.

However, on the other hand, if maintenance interval is shortened for any recording medium, maintenance is performed frequently to consume a lot of time for maintenance, resulting in drop in printing rate on a recording medium by the inkjet recording device. Further, as maintenance consumes ink, too frequent maintenance causes a problem of wasting ink a lot.

SUMMARY OF THE INVENTION

With this background, the present invention has an object to provide an inkjet recording apparatus that allows selection of a proper maintenance interval, corresponding to the type of recording medium having been input through an input section, and performs maintenance of a recording head/heads according to the selected maintenance interval, thereby preventing ink from curing on the nozzle surface/surfaces of the recording head/heads.

In an aspect of the invention, an inkjet recording apparatus includes a carriage having a recording head for jetting UV-curable ink to a recording medium and a UV light emitter for projecting UV light onto ink having landed on the recording medium to cure the ink, and a maintenance unit for performing maintenance of the recording head. The apparatus further includes an input section for inputting a type of recording medium, a storage section for storing plural types of recording media and plural maintenance intervals, the maintenance intervals corresponding to the respective types of recording media, and a controller for controlling the maintenance unit such that the controller selects one of the maintenance intervals, corresponding to one type of the types of recording media, the one type having been input through the input section, and performs maintenance operation, according to the selected maintenance interval.

In another aspect of the invention, there is provided a method for maintenance of a recording head of an inkjet recording apparatus that has a storage section for storing plural types of recording media and plural maintenance intervals, the maintenance intervals corresponding to the respective types of recording media, jets UV curable ink to a recording medium, and projects UV light onto ink having landed on the recording medium to cure the ink. The method includes the steps of inputting one of the plural types of recording media, selecting a maintenance interval from the plural maintenance intervals, the selected maintenance interval corresponding to the type of recording medium having been input; and performing maintenance operation, according to the selected maintenance interval.

DETAILED DESCRIPTION OF THE PREFERRED EMBODIMENT

Figure 1:
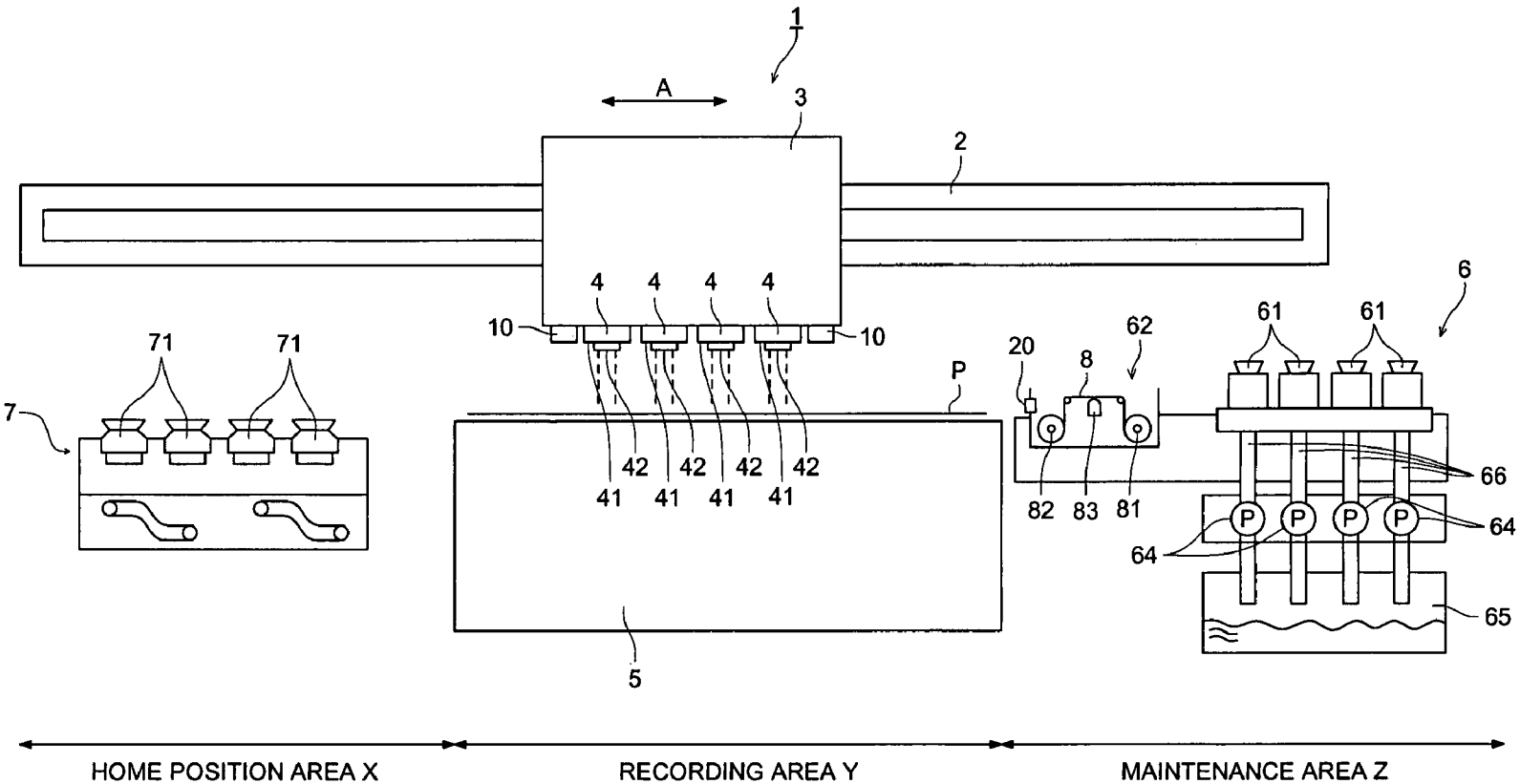
FIG. 1 is a schematic front view of an inkjet recording apparatus in accordance with the invention.

A preferred embodiment in accordance with the invention will be described below, referring to the drawings. However, the invention is not limited to the examples shown.

An inkjet recording apparatus 1 in the present embodiment includes a housing (not shown), inside of which a guide rail 2 is arranged extending in the right-and-left direction, as shown in FIG. 1. The guide rail 2 supports a carriage. 3 which is movable in a main scanning direction A in a predetermined range on the guide rail 2, driven by a carriage driving source 31 (see FIG. 2), of which view is not shown.

On the carriage 3, recording heads 4 are disposed with their longitudinal direction parallel to a sub scanning direction, and with nozzle surfaces 41 of the recording heads 4 facing a recording medium. From the jet openings of each nozzle 42, UV curable ink in one of the colors of yellow (Y), magenta (M), cyan (C), and black (B) is jetted onto the recording medium.

The inkjet recording apparatus 1 in the present embodiment is a serial type. However, the invention can also be applied to a line type inkjet recording apparatus. Herein, a serial type employs a method of recording an image in such a manner that a carriage having recording heads mounted on it is reciprocally moved in a main scanning direction A, while ink is jetted onto a recording medium from the recording heads. A line type employs a method of recording an image in such a manner that a plurality of recording heads are disposed in a main scanning direction A, and ink is jetted onto a recording medium from each recording head when the recording medium passes just below the recording head.

A UV light emitters 10 for projecting UV light are mounted on both the right and left ends of the carriage 3. One UV light emitter 10 is disposed on the further left side of a recording head 4 located at the left end, while the other UV light emitter 10 is disposed on the further right side of a recording head 4 located at the right end. A plurality of UV light sources is provided inside the UV light emitters 10. The UV light sources radiate UV light and are preferably arranged including at least one of a high-pressure mercury lamp, metal halide lamp, hot-cathode tube, cold-cathode tube, LED, electrodeless discharge lamp, excimer lamp, and low-pressure mercury lamp.

The central part of the scanning range of the carriage 3 is arranged as recording area Y for performing recording on a recording medium.

A flat plate formed platen 5 is provided in the recording area Y and below the carriage 3. The platen 5 supports a recording medium, from below in a flat form, on which recording is performed by the recording heads 4. A recording medium conveying mechanism 9 (see FIG. 2) for conveying a recording medium P in the sub scanning direction is provided inside the housing. The inkjet recording apparatus 1 is provided at the back of the housing with a slit-shaped feeding opening (not shown) for feeding a recording medium into inside the housing. A recording medium is fed through the feeding opening, and then the recording medium conveying mechanism 9 leads the recording medium so that the recording medium is supported by the platen 5. In this state, the recording medium passes inside the housing in the sub scanning direction, and gets ejected outside the housing.

The left side of the platen 5 in main scanning direction A serves as home position area X where the recording heads 4 wait while not performing image recording.

A light shielding unit 7 is arranged in home position area X. On the light shielding unit 7, light shielding caps 71 are provided in a number corresponding to the recording heads 4 so as to protect the nozzle surfaces 41 of the respective recording heads 4 by shielding light, particularly against UV light, while not performing image recording. Further, the light shielding unit 7 includes a light-shielding-unit moving mechanism, not shown, to move the light shielding unit 7 up and down.

The right side of the platen 5 in main scanning direction A serves as maintenance area Z for maintenance of the plurality of recording heads 4 mounted on the carriage 3. A maintenance unit 6 is provided in maintenance area Z.

The maintenance unit 6 includes suction caps 61 as cap members for covering the nozzle surfaces 41 of the respective recording heads 41, at the positions facing the respective recording heads 41 when the carriage 3 moves into the maintenance area Z, in a number corresponding to the recording heads. An ink communicating tube 66 communicating with inside the suction cap 61 is provided at the bottom of each suction cap 61. A suction pump 64 is provided in the mid-part of each communicating tube 66, and a disposed-ink tank 65 for receiving sucked ink is arranged at the bottom end of the communicating tubes 66.

The maintenance unit 6 includes an ink absorption device 62, neighboring the suction caps 61, to suck ink remaining in the nozzles 42 of the recording heads 4. The ink absorption device 62 is provided with a sending-out roll shaft 81 and a winding roll shaft 82 for winding an ink absorber 8 in a long sheet-shape. By driving a roll shaft driving mechanism, not shown, to rotate the winding roll shaft 82, the ink absorber 9 sent out from the sending-out roll shaft 81 is wound up by the winding roll shaft 82. Between the sending-out roll shaft 81 and the winding roll shaft 82 and under the ink absorber 8, a heater 83 is arranged to heat the ink absorber 8 from under to a temperature approximately 30 to 60° C. On one side of the winding roll shaft 82, a UV light emitting section 20 is provided to project UV light to the ink absorber 8, the emitting section 20 being a LED, for example.

Further, the maintenance unit 6 is provided with a maintenance unit moving mechanism, not shown, for moving the maintenance unit 6 up and down.

Next, a controller 100 in the present embodiment will be described, referring to FIG. 2.

Figure 2:
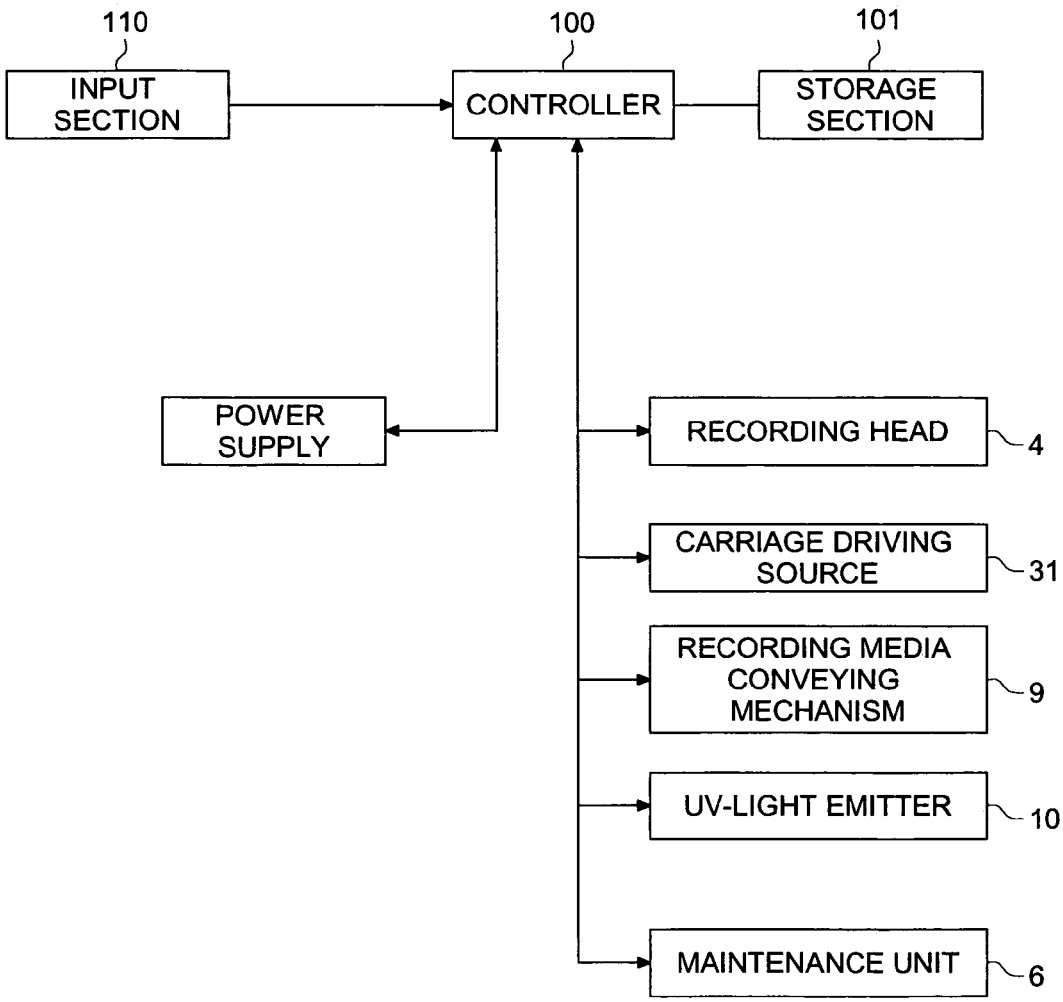
FIG. 2 is a block diagram showing a structure of a controller of the inkjet recording apparatus.

As shown in FIG. 2, the inkjet recording apparatus 1 includes a controller 100 for performing various processes. The controller 100 is connected with the carriage driving source 31, the recording medium conveying mechanism 9, the recording heads 4, the UV light emitters 10, and the maintenance unit 6 via respective interfaces (not shown). The controller 100 drives and controls the respective components as described above.

The controller 100 controls the carriage driving source 31 such that the carriage 3 reciprocally moves in main scanning direction A. In image recording, the controller 100 controls the recording medium conveying mechanism 9 such that the conveying mechanism conveys a recording medium in the sub scanning direction and controls the recording heads 4 such that the recording heads jet ink in a required color from the nozzles of the recording heads 4, based on image recording data. Then, the controller 100 controls the UV light emitters 10 such that the emitters project UV light onto ink having landed on the recording medium, and counts time of UV light projection by the UV light emitters 10. Further, the controller 100 selects a maintenance interval and controls the maintenance unit 6 such that the maintenance unit 6 starts maintenance operation, according to the selected maintenance interval.

Further, the inkjet recording apparatus 1 includes a storage section 101. The storage section 101 has a ROM in which various programs and data for various processes such as control and determination, and has a RAM for temporarily storing working areas for the various processes and data generated through the various processes.

Maintenance intervals corresponding to respective types of recording media are stored in the storage section 101 in advance. Each maintenance interval is determined by the amount of light energy of UV light that is reflected by each recording medium and reaches the nozzle surfaces 41 of the recording heads 4.

Figure 4:
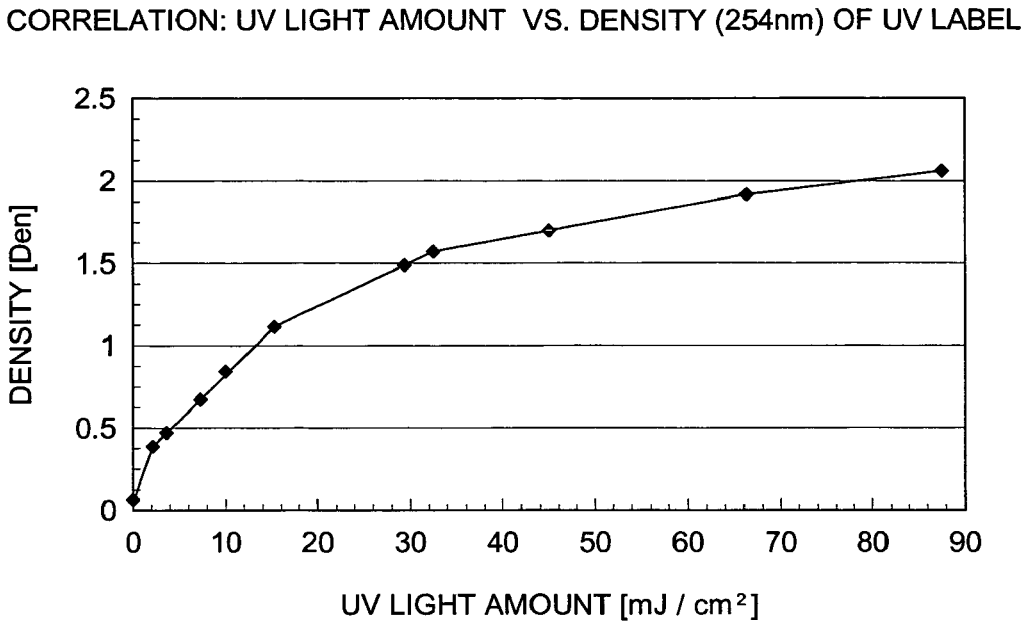
FIG. 4 is a graph showing the relationship between the amount of UV light and change in density of a UV label.

Herein, the amounts of light energy of UV light reflected by various recording media are recognized by the use of a UV label (UV label as a UV light indicator/type S/product of Nichiyu Giken Kogyo CO., Ltd.). As shown in FIG. 4, a UV label has a characteristic that as a projected UV light amount is increased, the density of color of the UV label increases. This UV label is pasted on the nozzle surface 41 of one of the recording heads 4, and change in the density of the UV label is measured after a predetermined time of operation.

Figure 5:
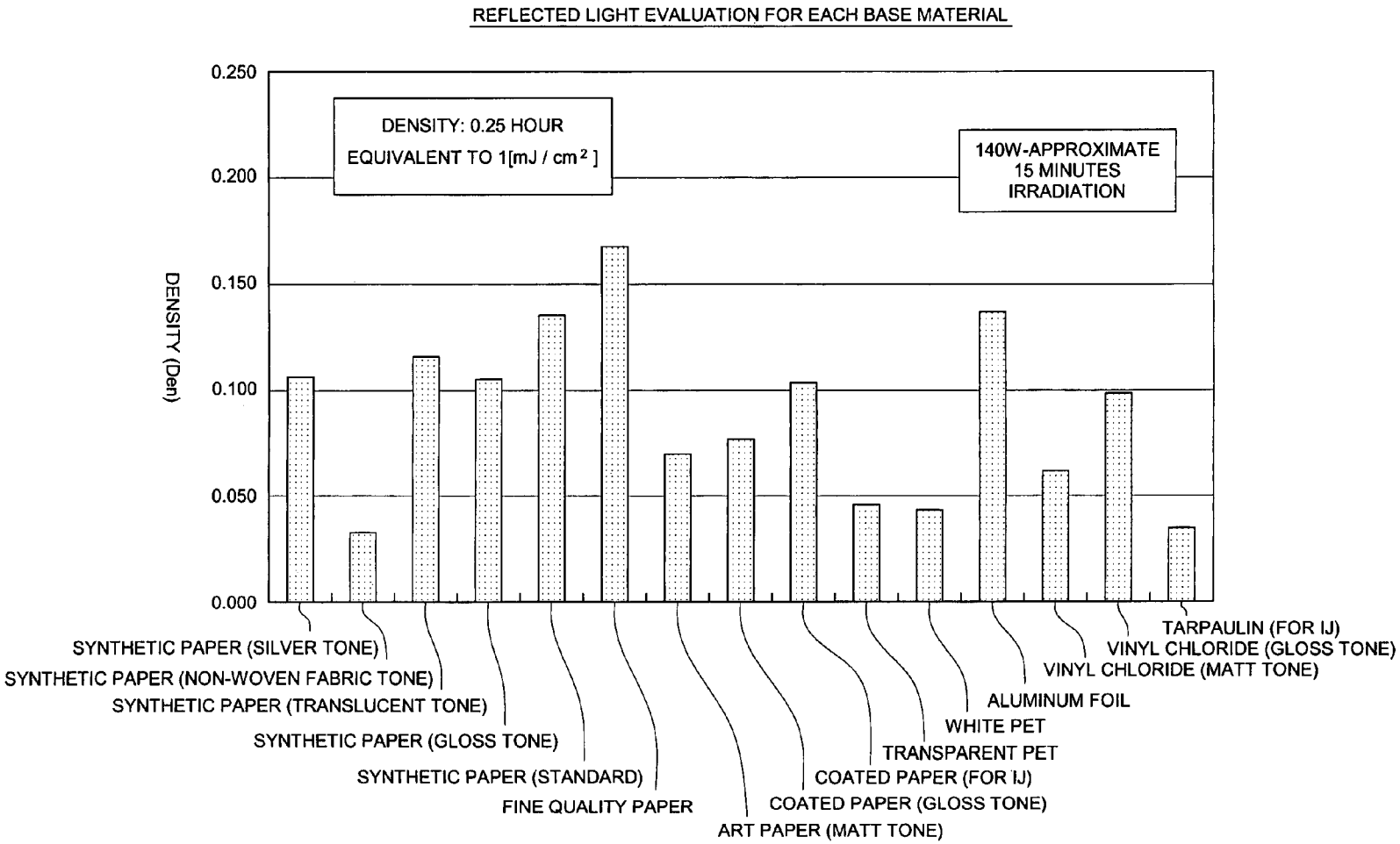
FIG. 5 is a graph showing the amount of light energy of reflected UV light that reaches a nozzle surface of a recording head, for respective recording media.

FIG. 5 shows a result of measuring change in the density of the UV label in a predetermined time for each recording medium. In general, UV light tends to specularly reflect on a recording medium with a small surface roughness such as a PET film, and tends to randomly reflect on a recording medium with a rough surface such as fine quality paper, aluminum foil, and coated paper. In a case where UV light randomly reflects on a recording medium, UV light reaches to parts (such as the nozzle surfaces 41 of the recording heads 4) other than the printing surface more easily compared to a case where UV light specularly reflects. Accordingly, as shown in FIG. 5, change in the density is smaller for PET films, while change in density is larger for fine quality paper, aluminum foil, coated paper, and the like.

In the present embodiment, based on the results mentioned above, the time taken for the density of the UV label to become 0.25 Den, that is, the time taken for the amount of light energy to become 1 $mJ/cm^2$, in conversion to light amount, is stored in the storage section as the maintenance interval for each recording medium. Herein, if maintenance operation is started before the amount of light energy becomes 1 $mJ/cm^2$ or larger, maintenance is performed before ink on the nozzle surfaces 41 starts getting cured, and thus it is possible to remove ink on the nozzle surfaces 41.

Herein, the larger the amount of light energy of reflected UV light that reaches the nozzle surfaces 41 of the recording heads 4 is, the more easily ink on the nozzle surfaces 41 gets cured. The density of the UV label is higher at a predetermined time for such a recording medium, and the time taken for the amount of light energy to become 1 mJ/cm2 is shorter. Conversely, the density of the UV label is lower at a predetermined time for a recording medium for which the amount of light energy of reflected UV light is smaller, and the time taken for the amount of light energy to become 1 mJ/cm2 is longer.

Therefore, in the present embodiment, shorter maintenance intervals are stored, in the storage section 101, corresponding to respective recording media with a larger amount of light energy of reflected UV light that reaches the nozzle surfaces of the recording heads 4, while longer maintenance intervals are stored corresponding to respective recording media with a smaller amount of light energy of reflected UV light that reaches the nozzle surfaces of the recording heads 4.

Further, the inkjet recording apparatus 1 includes an input section 110 having a keyboard and operation panel for inputting operation, data, and information. The input section 110 is structured such that a user can input the type of a recording medium. In the present embodiment, recording media for which the values of amount of light energy of reflected UV light are close to each other are categorized into the same category and can be selected via a button on the operation panel. In addition, it is also possible to arrange the operation in such a manner that the user inputs the name of a recording medium via the keyboard so that the controller 100 determines to which category the recording medium belongs, and then the controller 100 selects a maintenance interval corresponding to the recognized category.

Next, ink to be used in the present embodiment will be described. A polymerizable compound included in ink is subjected to polymerization reaction in curing the ink. Inks to be used in the present embodiment contain an activation energy curable compound as a polymerizable compound. They are UV-curable inks for which UV-light is employed as activation energy to initiate polymerization reaction.

UV-curable inks can be roughly categorized into radical curable inks containing a radical polymerizable compound and cation curable inks containing a cation polymerizable compound, both of which are applicable as ink to be used in the present embodiment. Further, a hybrid type ink in combination of a radical curable ink and a cation curable ink may be employed as ink to be used in the present embodiment.

However, cation curable inks are inhibited from polimarization reaction by oxygen little or virtually not, and advantageous in functionality and generality. Therefore, cation curable inks are particularly used in the present embodiment. Specifically, cation curable inks employed in the present embodiment are mixtures containing, at least, a cation curable compound such as an oxetan compound, epoxy compound, or vinyl ether compound, and containing a light cation initiator and a colorant, having a characteristic of being cured by exposure to the above described UV-light.

The viscosity of inks used in the present embodiment is 10 to 50 mPa·s and the surface tension is 20 to 40 mN/m at a temperature of 25° C., which means the inks have a high viscosity and a low wettabllity.

As a recording media used in the present embodiment, it is possible to use materials which are applied to a common inkjet recording device, including various paper such as plain paper, recycled paper, and glossy paper, various cloths, various nonweave cloths, resins, metals, and glasses. Applicable shapes of the recording media are, for example, a roller shape, cutsheet shape, and plate shape.

Still further, as a recording medium used in the present embodiment, it is also possible to apply known opaque recording media including various paper sheets of which surface is covered with a resin, films containing pigment, and foaming films.

Next, operation of the inkjet recording apparatus 1 arranged as described above will be described, referring to FIG. 3.

First, in the inkjet recording apparatus 1 in the present embodiment, when power is turned on, the UV light sources of the UV light emitters 10 turn on. The UV light sources in the present embodiment always maintain the state of lighting until the power is turned off.

When specific image recording data is input to the controller 100, the inkjet recording apparatus 1 starts image recording. In recording an image, the controller 100 drives the carriage 3 having the recording heads 4 and the UV light emitters 10 mounted thereon so as to reciprocally drive the recording heads 4 and the UV light emitters 10 in main scanning direction A, and conveys a recording medium in the sub scanning direction by the recording medium conveying mechanism 9, while the controller 100 makes inks in respective required colors jetted from the nozzles of recording heads 4, based on image recording data. Then, the inks jetted from the nozzles of recording heads 4 land on the recording medium and get exposed to UV light emitted from the UV light emitters 10 to be cured. Thus, an image is recorded on the recording medium.

Figure 3:
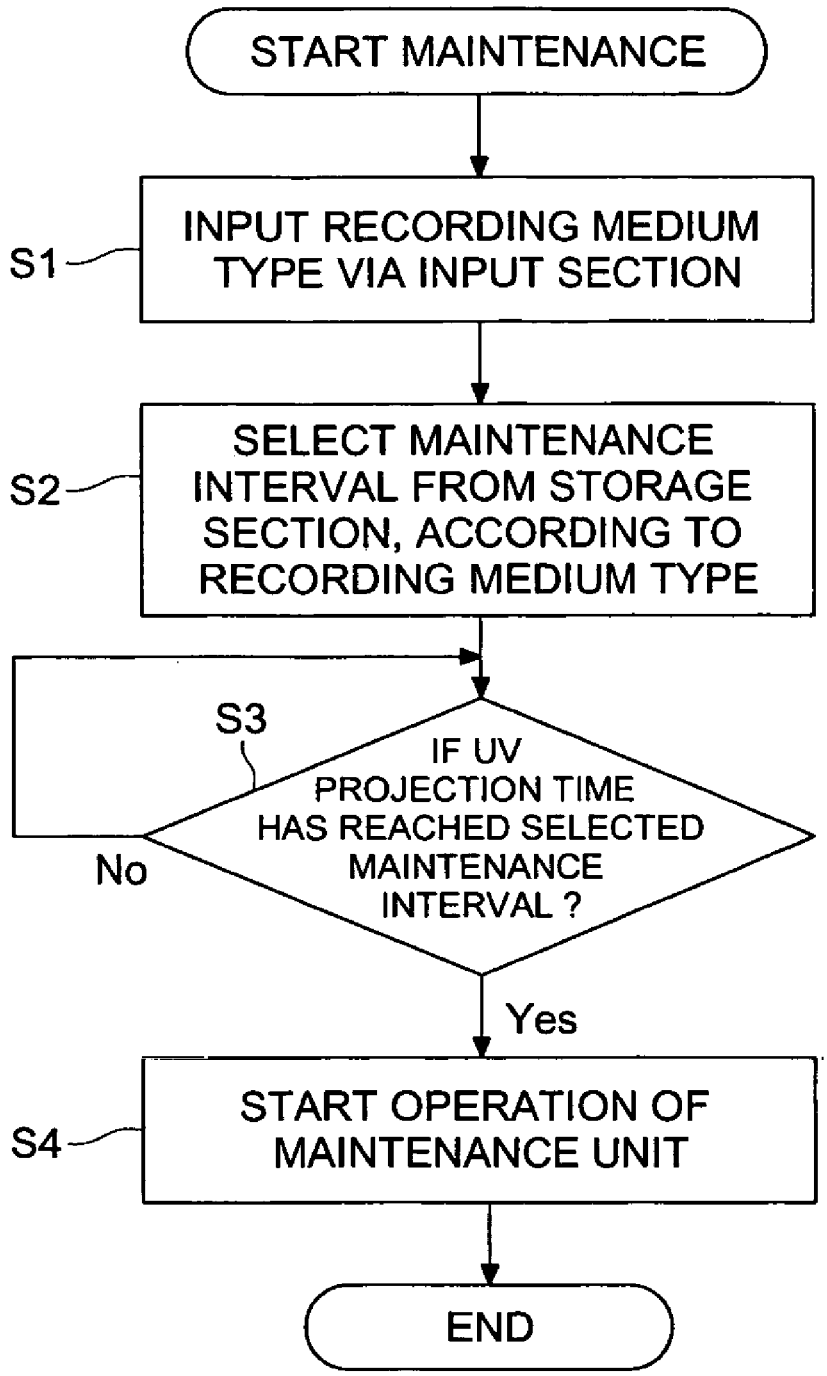
FIG. 3 is a flowchart showing a maintenance processing for the inkjet recording apparatus.

Next, maintenance processing performed in the inkjet recording apparatus 1 will be described by the use of a flowchart in FIG. 3.

First, a user inputs a type of recording medium via the input section 110 (step S1).

If a type of recording medium is input via the input section 110, then the controller 100 selects, from the storage section 101, a maintenance interval which corresponds to the type of recording medium having been input, in a state where the carriage 3 is in recording area Y or in home position area X (step S2).

That is, the controller 100 selects a shorter maintenance interval for a recording medium in a category of a larger amount of light energy of reflected UV light, while the controller 100 selects a longer maintenance interval for a recording medium in a category of a smaller mount of light energy of reflected UV light.

If the name of a recording medium having not been stored in the storage section in advance is input via the input section 110 with the keyboard or the like, the controller 100 selects the shortest maintenance interval corresponding to the category for recording media of which amount of light energy of reflected UV light are the largest.

The controller 100 counts accumulated time of UV light projection by the light sources of the UV light emitters 10, and determines whether this accumulated time has reached the time period for the selected maintenance interval (step S3). If the controller 100 has determined that the UV light projection time has reached the time period for the selected maintenance interval, then the controller 100 moves the carriage 3 having the recording heads 4 and the UV light emitters 10 to maintenance area Z.

When the recording heads 4 have reached maintenance area Z, the controller 100 makes the maintenance unit 6 start maintenance operation (step S4).

When the recording heads 4 have reached the position of the suction caps 61, the controller 100 moves up the maintenance unit 6. Thus, the suction caps 61 arranged on the maintenance unit 6 cover the nozzle surfaces 41 of the respective heads 4 to seal the surfaces. Further, the controller 100 runs the suction pumps 64 to generate a negative pressure inside the suction caps 61 so as to suck ink in the nozzles 42. Sucked ink is conveyed through the ink communicating tubes 66 to the disposed-ink tank 65 to be accumulated. After sucking ink, the controller 100 moves down the maintenance unit 6 and separates the suction caps 61 from the nozzle surfaces 41 of the nozzles 42.

Next, when the recording heads 4 have moved to the position of the ink absorption device 62, the controller 100 moves up the maintenance unit 6. Thus, the ink absorber 8 supported by the sending-out roll shaft 81 and the winding roll shaft 82 comes in contact with the nozzle surfaces 41 to absorb ink deposited on the nozzle surfaces 41. Then, the controller 100 drives a roll-shaft driving mechanism to rotate the winding roll shaft 82, and thereby the ink absorber 8 sent out from the sending-out roll shaft 81 is wound around the winding roll shaft 82. Herein, the controller 100 drives the UV light emitting section 20 to project UV light onto the ink absorber 8 so that ink absorbed by the ink absorber 8 is cured. Finally, the controller 100 performs dummy jetting of ink from the nozzles 42 to the ink absorber 8. Then, the controller 100 moves down the maintenance unit 6 and separates the ink absorber 8 from the nozzle surfaces 41.

In such a manner, the maintenance processing on the recording heads 4 is completed, and the controller 100 moves the carriage 3 to home position area X.

When the maintenance processing has been completed, the controller 100 resumes counting time of UV light projection, and when the time of UV light projection reaches or exceeds the time period of a selected maintenance interval, the controller 100 starts maintenance operation in the same way as stated above.

When the user has input a different type of recording medium via the input section 110, a maintenance interval corresponding to the different type is selected from the storage section 101, and the maintenance unit 6 is controlled in the same way as stated above, according to the newly selected maintenance interval.

As mentioned above, according to the invention, as maintenance intervals corresponding to respective recording media are stored in advance, a user is only required to input the type of a recording medium so that a proper maintenance interval is selected. Further, each maintenance interval is determined by the amount of light energy of reflected UV light that reaches nozzle surfaces 41 of recording heads, and accordingly, an optimal maintenance interval corresponding to the amount of light energy can be selected. Therefore, by selecting a shorter maintenance interval for a recording medium with which ink on the nozzle surfaces 41 is easily cured due to a larger amount of light energy, curing of ink on the nozzle surfaces 41 can be effectively prevented. Further, by selecting a longer maintenance interval for a recording medium with which ink on the nozzle surfaces 41 is not easily cured due to a smaller amount of light energy, it is possible to minimize wasteful ink consumption and increase the productivity of the inkjet recording apparatus. In such a manner, by changing the maintenance interval, according to the type of a recording medium, it is possible to perform an optimal maintenance, which prevents curing of ink and reduces consumption of wasteful ink. Particularly, cation-curable ink has a characteristic of accumulating light energy, and accordingly even in the case of light energy in a tiny amount, light energy is accumulated as time elapses to finally cure the cation-curable ink. Further, ink having been cured once cannot be removed by maintenance. However, by selecting a proper maintenance interval as stated above, maintenance can be performed before curing of ink on the nozzle surfaces 41 to prevent curing of ink.

Particularly, UV curable ink can be used for printing on any type of recording medium, and a high image quality can be obtained on any type of recording medium by selecting a maintenance interval, according to the type of recording medium for printing in this way, and by thus optimally preventing curing of ink on the nozzle surfaces 41.

The invention includes the following structures.

(1) An inkjet recording apparatus includes a carriage having a recording head for jetting UV-curable ink onto a recording medium and a UV light emitter for emitting UV light onto ink having landed on the recording medium to cure the ink, a maintenance unit for performing maintenance of the recording head, an input section for inputting a type of recording medium, a storage section for storing types of recording media with corresponding maintenance intervals, and a control section for selection of a maintenance interval, corresponding to the type of recording medium having been input through the input section, and for control of the maintenance unit such that maintenance is performed according to the selected maintenance interval.

According to above item (1), when a user inputs a type of recording medium through the input section, the control section selects a maintenance interval, from the storage section, corresponding to the type of recording medium. Types of recording media and maintenance intervals are stored in the storage section correspondingly in advance, and accordingly, by just inputting a type of recording medium, an optimum maintenance interval suitable for the type of recording medium is selected. If maintenance interval has been selected in such a manner, the control section starts maintenance operation, according to the maintenance interval. If the user inputs another type of recording medium through the input section, the control section selects a maintenance interval suitable for the other recording medium from the storage section, and starts maintenance operation, according to the newly selected maintenance interval. Thus, even when a different type of recording medium is to be used, if the user just inputs the type of recording medium through the input section, maintenance can always be performed at an optimum maintenance interval.

According to item (1), as an optimum maintenance interval is selected according to the type of a recording medium for printing, curing of ink on a nozzle surface can be effectively prevented.

Thus, even when UV light for curing ink is diffusively reflected to a portion other than printing surfaces, for example, the nozzle surface of a recording head, it is possible to perform maintenance before ink having deposited on the nozzle surface start being cured to prevent problems including failure of jetting ink from nozzles. It is also possible to prevent curing of ink on a nozzle surface even if a UV light emitting device is disposed near a recording head.

Further, while it is understood that UV curable ink can be used for printing on any type of recording medium, a high image quality can be obtained on any type of recording medium, according to item (1).

Particularly, although cation curable ink accumulates light energy as time elapses to be cured finally and ink once having been cured cannot be removed by maintenance, maintenance is performed before ink on a nozzle surface is cured, by selecting such a proper maintenance interval.

On the other hand, by setting a longer maintenance interval for a recording medium with which ink is not cured easily, wasteful ink consumption can be minimized and time used for maintenance can be shortened, thereby the printing rate by an inkjet recording apparatus can be increased.

(2) In the inkjet recording apparatus of item (1), each maintenance interval is determined, according to the amount of light energy of UV light that is reflected by a corresponding one of the recording media and reaches a nozzle surface of the recording head.

According to item (2), each maintenance interval is determined, according to the energy of UV light that is reflected by a corresponding medium and reaches the nozzle surface of a recording head. Therefore, for recording media with a large amount of light energy, that is, recording media which easily cure ink on a nozzle surface, shorter maintenance intervals are selected, and for recording media with a small amount of light energy, that is, recording media which do not cure ink on a nozzle surface easily, longer maintenance intervals are selected. In such a manner, optimum maintenance intervals corresponding to energies of reflected UV light can be selected for respective recording media.

According to item (2), a maintenance interval is changed based on the amount of light energy. Therefore, by selecting a shorter maintenance interval for a recording medium with which ink is easily cured due to a larger amount of light energy, curing of ink on a nozzle surface can be effectively prevented. Further, by selecting a longer maintenance interval for a recording medium with which ink is not easily cured due to a smaller amount of light energy, it is possible to reduce wasteful ink consumption and the number of times of maintenance, thereby increasing a printing rate.

(3) For the inkjet recording apparatus of item (2), the maintenance interval is shorter as the amount of light energy is larger.

According to item (3), for recording media for which the amount of energy of reflected UV light that reaches the nozzle surface of a recording head is large, maintenance intervals are set short, and thus maintenance is performed frequently for the recording media that easily cure ink on nozzle surface, thereby the ink on the nozzle surface being effectively prevented from being cured.

According to item (3), the larger the amount of light energy of light reflected by a recording medium, the shorter the applied maintenance interval. Therefore, curing of ink on a nozzle surface is effectively prevented to be able to always obtain high image quality.

(4) For the inkjet recording apparatus of item (2) or (3), each maintenance interval is set to a time taken for the amount of light energy to become 1 $mJ/cm^2$.

According to item (4), as maintenance operation starts when the amount of light energy becomes 1 $mJ/cm^2$, it is possible to perform maintenance before ink starts being cured on the nozzle surface.

According to item (4), the amount of light energy at which maintenance starts is specified. Therefore, maintenance is performed before ink on a nozzle surface starts being cured so that curing of ink is prevented, allowing it to always obtain high image quality.

(5) In the inkjet recording apparatus of any one of items (1) to (4), the control section counts time of projecting UV light from the UV light emitter to implement each maintenance interval.

According to item (5), as maintenance interval is implemented by counting the UV light projection time, a maintenance unit starts maintenance operation before the time of projecting UV light onto ink deposited on the nozzle surface exceeds a certain time period and the ink is cured.

According to item (5), a maintenance interval is properly selected so that maintenance operation starts before ink deposited on a nozzle surface is exposed to UV light for a time exceeding a certain time period and ink is cured. Thus, it possible to effectively prevent curing of ink on the nozzle surface.

(6) In the inkjet recording apparatus of any one of items (1) to (5), the maintenance unit includes a suction cap and an ink absorbing device.

According to item (6), ink deposited on the nozzle surface of a recording head is sucked and absorbed to be removed, which prevents curing of ink on the nozzle surface.

According to item (6), ink on a nozzle surface is prevented from being cured, by maintenance including suction and absorption of the ink. Therefore, it is possible to prevent failure in jetting ink from a recording head, thereby always obtaining a stable high image quality.

(7) In the inkjet recording apparatus of any one of items (1) to (6), the recording head is a recording head of a serial type.

According to item (7), an inkjet recording apparatus of a serial type has functions as those described in item (1) to (6).

According to item (7), the same effects as described in items (1) to (6) can be obtained, using a serial type inkjet recording apparatus.

(8) In the inkjet recording apparatus of any one of items (1) to (6), the recording head is a recording head of a line type.

According to item (8), an inkjet recording apparatus of a line type has functions as those described in item (1) to (6).

According to item (8), the same effects as described in items (1) to (6) can be obtained, using a line type inkjet recording apparatus.

(9) In the inkjet recording apparatus of any one of items (1) to (8), one of a low-pressure mercury lamp, high-pressure mercury lamp, metal halide lamp, hot-cathode tube, cold-cathode tube, LED, electrodeless discharge lamp, and excimer lamp is employed as a UV light source of the UV light emitting device.

As described in item (9), if one of a low-pressure mercury lamp, high-pressure mercury lamp, metal halide lamp, hot-cathode tube, cold-cathode tube, LED, electrodeless discharge lamp, and excimer lamp is employed as a UV light source of the UV light emitting device, functions as those described in any one of items (1) to (8) are provided.

According to item (9), the same effects as described in items (1) to (8) can be obtained, employing one of a low-pressure mercury lamp, high-pressure mercury lamp, metal halide lamp, hot-cathode tube, cold-cathode tube, LED, electrodeless discharge lamp, and excimer lamp as a UV light source of the UV light emitter.

(10) The inkjet recording apparatus of any one of items (1) to (9) uses ink having a viscosity of 10 to 50 mPa·s and a surface tension of 20 to 40 mN/m at a temperature of 25° C.

According to item (10), the inkjet recording apparatus can employ an ink having a viscosity of 10 to 50 mPa·s and a surface tension of 20 to 40 mN/m at a temperature of 25° C.

According to item (10), the inkjet recording apparatus can employ an ink having a viscosity of 10 to 50 mPa·s and a surface tension of 20 to 40 mN/m at a temperature of 25° C. Therefore, an effect is obtained that makes it possible to record an image on a recording surface of a recording an inkjet recording medium with a large width by an inkjet recording apparatus.

What is claimed is:

1. An inkjet recording apparatus, comprising:

a carriage having a recording head for jetting UV-curable ink onto a recording medium and a UV light emitter for projecting UV light onto ink having landed on the recording medium to cure the ink;

a maintenance unit for performing maintenance of the recording head;

an input section for inputting a type of recording medium;

a storage section for storing plural types of recording media and plural maintenance intervals, the maintenance intervals corresponding to the respective types of recording media; and a controller for controlling the maintenance unit such that the controller selects one of the maintenance intervals, corresponding to one type of the plural types of recording media, the one type having been input through the input section, and performs maintenance operation, according to the selected maintenance interval, wherein each maintenance interval is determined, according to an amount of light energy of UV light that is reflected by a corresponding one of the types of recording media and reaches a nozzle surface of the recording head.

2. The inkjet recording apparatus of claim 1, wherein each maintenance interval is shorter as the amount of light energy is larger.

3. The inkjet recording apparatus of claim 1, wherein each maintenance interval is set to a time taken for the amount of light energy to become 1 $mJ/cm^2$.

4. The inkjet recording apparatus of claim 1, wherein the controller implements the selected maintenance interval by counting time of projecting UV light from the UV light emitter.

5. The inkjet recording apparatus of claim 1, wherein the maintenance unit includes a suction cap and an ink absorption device.

6. The inkjet recording apparatus of claim 1, wherein the recording head is a serial type of recording head.

7. The inkjet recording apparatus of claim 1, wherein the recording head is a line type of recording head.

8. The inkjet recording apparatus of claim 1, wherein one of a low-pressure mercury lamp, high-pressure mercury lamp, metal halide lamp, hot-cathode tube, cold-cathode tube, LED, electrodeless discharge lamp, and excimer lamp is employed as a UV light source of the UV light emitter.

9. The inkjet recording apparatus of claim 1, wherein the apparatus uses ink having a viscosity of 10 to 50 mPa·s and a surface tension of 20 to 40 mN/in at a temperature of 25° C.

* * * * *